US010239318B2

(12) United States Patent
Takaai et al.

(10) Patent No.: US 10,239,318 B2
(45) Date of Patent: Mar. 26, 2019

(54) LIQUID DISCHARGE APPARATUS AND MAINTENANCE METHOD FOR THE LIQUID DISCHARGE APPARATUS

(71) Applicant: SEIKO EPSON CORPORATION, Tokyo (JP)

(72) Inventors: Hitoshi Takaai, Azumino (JP); Shunsuke Watanabe, Matsumoto (JP); Shingo Tomimatsu, Matsumoto (JP); Kohei Yuwaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/660,696

(22) Filed: Jul. 26, 2017

(65) Prior Publication Data

US 2018/0043690 A1 Feb. 15, 2018

(30) Foreign Application Priority Data

Aug. 10, 2016 (JP) ..... 2016-157193

(51) Int. Cl.
*B41J 2/165* (2006.01)
*B41J 2/14* (2006.01)
*B41J 2/175* (2006.01)

(52) U.S. Cl.
CPC ..... *B41J 2/16517* (2013.01); *B41J 2/14233* (2013.01); *B41J 2/16526* (2013.01); *B41J 2/175* (2013.01); *B41J 2002/14419* (2013.01); *B41J 2002/16573* (2013.01); *B41J 2202/11* (2013.01)

(58) Field of Classification Search
CPC ..... B41J 2/16517; B41J 2/14145
USPC ..... 347/35
See application file for complete search history.

(56) References Cited

U.S. PATENT DOCUMENTS 5,455,615 A * 10/1995 Burr ..... B41J 2/1652 347/35
6,312,087 B1 * 11/2001 Imai ..... B41J 2/16532 347/23
2002/0196301 A1 * 12/2002 Murakami ..... B41J 2/1404 347/15
2007/0188538 A1 * 8/2007 Izuo ..... B41J 2/16579 347/19
2008/0129776 A1 * 6/2008 Taira ..... B41J 2/16526 347/33

(Continued)

FOREIGN PATENT DOCUMENTS

JP 2015-030153 2/2015

*Primary Examiner* — Huan H Tran
*Assistant Examiner* — Alexander D Shenderov
(74) *Attorney, Agent, or Firm* — Workman Nydegger

(57) ABSTRACT

A liquid discharge apparatus includes a plurality of pressure chambers that generate a pressure for discharging a liquid, a plurality of nozzles that communicate individually with the pressure chambers and that discharge the liquid, a common liquid chamber that includes a plurality of supply openings and that has, at an end portion side in an arrangement direction of the supply openings, a region in which flow speed of the liquid flowing toward the supply openings is higher than in another region, and a controller that controls a maintenance by expelling the liquid from the nozzles. During the maintenance, the controller controls expelling the liquid from a first nozzle to a second nozzle that is one of nozzles located on the end portion side of the first nozzle in the arrangement direction of the supply openings, in an order of the first nozzle to the second nozzle.

18 Claims, 9 Drawing Sheets

(56) References Cited

U.S. PATENT DOCUMENTS

| | | | | |
|---|---|---|---|---|
| 2010/0165034 | A1* | 7/2010 | DeVore | B41J 29/393 347/19 |
| 2015/0035910 | A1 | 2/2015 | Kinoshita et al. | |

* cited by examiner

LIQUID DISCHARGE APPARATUS AND MAINTENANCE METHOD FOR THE LIQUID DISCHARGE APPARATUS

The entire disclosure of Japanese Patent Application No. 2016-157193, filed Aug. 10, 2016 is expressly incorporated by reference herein.

BACKGROUND

1. Technical Field

The present invention relates to a technology that distributes a liquid such as ink.

2. Related Art

In a liquid discharge apparatus that discharges ink from nozzles that communicate with pressure chambers provided in a liquid discharge head by changing the pressure inside each pressure chamber, there is a risk of incomplete discharge from a nozzle occurring because of a bubble having entered a common liquid chamber that communicates with a plurality of pressure chambers so as to supply ink. Therefore, technologies that expel ink from nozzles to expel bubbles with flows of ink during maintenance have been proposed. For example, in JP-A-2015-30153, taking it into account that the longer and narrower the internal space (flow path) of a common liquid chamber is made in a direction in which ink supply openings to pressure chambers are aligned, the more easily bubbles reside, the flow speed of ink is made relatively high at end portions of the common liquid chamber in the alignment direction of the ink supply openings to the pressure chambers at the time of expelling ink from the nozzles during maintenance, so that bubbles are easily expelled with flows of ink.

However, the local increase of the flow speed of ink at the end portions of the common liquid chamber in the alignment direction of the ink supply openings to the pressure chambers as in JP-A-2015-30153 does not necessarily cause bubbles residing at locations other than the end portions (e.g., in a central portion) to be easily expelled. Increasing the amount of ink discharged from the nozzle during maintenance will increase the overall flow speed of ink in the common liquid chamber and therefore will more easily expel bubbles. However, this will result in increased amounts of ink expelled for maintenance.

SUMMARY

An advantage of some aspects of the invention is that the bubble expelling capability is improved while the amount of liquid expelled during maintenance is restrained.

An aspect of the invention provides a liquid discharge apparatus that includes a plurality of pressure chambers that generate a pressure for discharging a liquid, a plurality of nozzles that communicate individually with the pressure chambers arranged in one direction and that discharge the liquid from the pressure chambers, a common liquid chamber that includes a plurality of supply openings which are arranged along an arrangement of the pressure chambers and through which the liquid is supplied individually to the pressure chambers and that has, at an end portion side in an arrangement direction of the supply openings, a region in which flow speed of the liquid flowing toward the supply openings is higher than in another region, and a controller that controls a maintenance by expelling the liquid from the nozzles. During the maintenance, the controller controls expelling the liquid from a first nozzle that is one of the nozzles from which the liquid is expelled during the maintenance to a second nozzle that is one of nozzles located on the end portion side of the first nozzle in the arrangement direction of the supply openings, in an order of the first nozzle to the second nozzle. According to the foregoing construction, during maintenance, the liquid expelling is performed in the order of the first nozzle to the second nozzle, so that local flows toward which bubbles are drawn are generated in the common liquid chamber in the order of the supply opening that communicates with the pressure chamber of the first nozzle to the supply opening that communicates with the pressure chamber of the second nozzle. Since the second nozzle is located at the end portion side of the first nozzle, local flows in the common liquid chamber shift toward the end portion. Because of this, bubbles in the common liquid chamber are drawn by local flows to move in the direction toward the end portion so that bubbles are led to a region in which the flow speed is high. In a region with high flow speed, bubbles are more likely to be expelled than in other regions. Therefore, moving bubbles into a region of the end portion in which the flow speed is high will improve the capability of expelling bubbles while minimizing the amount of ink expelled during the maintenance process.

Another aspect of the invention provides a liquid discharge apparatus that includes a plurality of pressure chambers that generate a pressure for discharging a liquid, a plurality of nozzles that communicate individually with the pressure chambers arranged in one direction and that discharge the liquid from the pressure chambers, a common liquid chamber that has an inlet opening through which the liquid flows into the common liquid chamber and a plurality of supply openings which are arranged along an arrangement of the pressure chambers and through which the liquid is supplied individually to the pressure chambers, and a controller that controls a maintenance by expelling the liquid from the nozzles. The common liquid chamber has a first width in the one direction on which the inlet opening is located and a second width in the one direction on which the supply openings are located and the second width is greater than the first width. During the maintenance, the controller controls expelling the liquid from a first nozzle that is one of the nozzles from which the liquid is expelled during the maintenance and a second nozzle that is one of nozzles located on the end portion side of the first nozzle in the arrangement direction of the supply openings, in an order of the first nozzle to the second nozzle. According to the foregoing construction, since the common liquid chamber has the first width in the one direction on which the inlet opening is located and the second width in the one direction on which the supply openings are located and the second width is greater than the first width, a region in which the flow speed of the liquid flowing to supply openings is higher than in other regions exists at the end portion side in the alignment direction of the supply openings (the one direction). During the maintenance, the liquid expelling is performed in the order of the first nozzle to the second nozzle, so that local flows that draw bubbles are generated in the common liquid chamber in the order of the supply opening that communicates with the pressure chamber of the first nozzle to the supply opening that communicates with the pressure chamber of the second nozzle. Since the second nozzle is located at the end portion side of the first nozzle, local flows in the common liquid chamber shift toward the end portion. Because of this, bubbles in the common liquid chamber are drawn by local flows to move in the direction toward the end portion so that bubbles are led to a region in which the flow speed is high. In a region with high flow speed, bubbles are more likely to be expelled than in other regions. Therefore, moving bubbles into a region of the end portion in which the flow speed is high will improve the capability of expelling bubbles while minimizing the amount of ink expelled during the maintenance process.

In either one of the foregoing aspects of the invention, the first nozzle and the second nozzle may be adjacent to each other. In this construction, the first nozzle and the second nozzle are adjacent to each other. Therefore, during the maintenance, performing the liquid expelling in the order of the first nozzle to the second nozzle will reduce intervals between local flows generated in the common liquid chamber. Therefore, bubbles can be easily moved to the end portion side even when the bubbles are in a region with low flow speed.

Furthermore, the plurality of nozzles may include a plurality of the first nozzle adjacent to each other and a plurality of the second nozzle adjacent to each other. According to this construction, during the maintenance, the liquid expelling performed in the order of the plurality of first nozzles to the plurality of second nozzles will generate local flows through a plurality of supply openings at a time, so that the moving speed of bubbles will increase.

In the foregoing aspects of the invention, the first nozzle and the second nozzle may be nozzles separated from each other by at least one of the nozzles. According to this construction, since the first nozzle and the second nozzle are separated from each other by one or more nozzles, the maintenance in which the liquid expelling is performed in the order of the first nozzle to the second nozzle increases intervals between local flows generated in the common liquid chamber. There, bubbles can be easily moved to the end portion side even when the bubbles are in a region with high flow speed.

In the foregoing aspects of the invention, the common liquid chamber may have a first region that includes a central portion in the arrangement direction of the supply openings and a second region located at the end portion side of the first region and, of the nozzles from which the liquid is expelled during the maintenance, nozzles in the second region are separated from each other by an interval that is longer than an interval by which nozzles in the first region are separated from each other. In this construction, a high-flow speed region exists at the end portion of the common liquid chamber, so that the flow speed is higher at the end portion side than at the central portion side. Therefore, even when, as in this construction, intervals by which the nozzles in the second region from which the liquid is expelled during the maintenance are separated from each other are made longer than intervals by which the nozzles in the first region are separated from each other, bubbles can be sufficiently moved. This achieves an overall reduction of the amount of the liquid expelled during the maintenance.

In the foregoing aspects of the invention, the common liquid chamber may include a first region that includes a central portion in the arrangement direction of the supply openings and a second region located at the end portion side of the first region and, of the nozzles from which the liquid is expelled during the maintenance, nozzles in the second region each have a less amount of the liquid expelled than each of nozzles in the first region. In this construction, a high-flow speed region exists at the end portion of the common liquid chamber, so that the flow speed is higher at the end portion side than at the central portion side. Therefore, even when, as in this construction, the amount of the liquid expelled from each of the nozzles in the second region is less than the amount of the liquid expelled from each of the nozzles in the first region, bubbles can be sufficiently moved. This achieves an overall reduction of the amount of the liquid expelled during the maintenance.

In the foregoing aspects of the invention, the common liquid chamber may include a first region that includes a central portion in the arrangement direction of the supply openings and a second region located at the end portion side of the first region and number of nozzles from which the liquid is expelled during the maintenance is less in the second region than in the first region. In this construction, a high-flow speed region exists at the end portion of the common liquid chamber, so that the flow speed is higher at the end portion side than at the central portion side. Therefore, even when, as in this construction, the number of nozzles in the second region from which the liquid is expelled during the maintenance is made less than the number of such nozzles in the first region, bubbles can be sufficiently moved. This achieves an overall reduction of the amount of the liquid expelled during the maintenance.

Still another aspect of the invention provides a liquid discharge apparatus that includes a plurality of pressure chambers that generate a pressure for discharging a liquid, a plurality of nozzles that communicate individually with the pressure chambers arranged in one direction and that discharge the liquid from the pressure chambers, a common liquid chamber that includes a plurality of supply openings which are arranged along an arrangement of the pressure chambers and through which the liquid is supplied individually to the pressure chambers and that has, at an end portion side in an arrangement direction of the supply openings, a region in which flow speed of the liquid flowing toward the supply openings is higher than in another region, and a controller that controls a maintenance by expelling the liquid from the nozzles. During the maintenance, the controller controls expelling the liquid from nozzles and stops expelling the liquid in an order of a first nozzle that is one of the nozzles from which the liquid is expelled during the maintenance to a second nozzle that is one of nozzles located on the end portion side of the first nozzle in the arrangement direction of the supply. According to this construction, when, during the maintenance, the liquid is expelled from a plurality of nozzles and the liquid expelling is stopped in the order of the first nozzle to the second nozzle, bubbles in the common liquid chamber are drawn to move toward where flows are generated. Because of this, bubbles in the common liquid chamber move toward the end portion and are therefore led to a high-flow speed region. Since in a high-flow speed region, bubbles are more likely to be expelled than in other regions, movement of bubbles to a high-flow speed region of the end portions will improve the capability of expelling bubbles while minimizing the amount of the liquid expelled during the maintenance.

Yet another aspect of the invention provides a liquid discharge apparatus that includes a plurality of pressure chambers that generate a pressure for discharging a liquid, a plurality of nozzles that communicate individually with the pressure chambers arranged in one direction and that discharge the liquid from the pressure chambers, a common liquid chamber that has an inlet opening through which the liquid flows into the common liquid chamber and a plurality of supply openings which are arranged along an arrangement of the pressure chambers and through which the liquid is supplied individually to the pressure chambers, and a controller that controls a maintenance by expelling the liquid from the nozzles. The common liquid chamber has a first width in the one direction on which the inlet opening is located and a second width in the one direction on which the supply openings are located and the second width is greater than the first width. During the maintenance, the controller controls expelling the liquid from nozzles and stops expelling the liquid from a first nozzle that is one of the nozzles from which the liquid is expelled during the maintenance and a second nozzle that is one of nozzles located on the end portion side of the first nozzle in the arrangement direction of the supply openings, in an order of the first nozzle to the second nozzle. According to this construction, since the common liquid chamber has the first width in the one direction on which the inlet opening is located and the second width in the one direction on which the supply openings are located and the second width is greater than the first width, a region in which the flow speed of the liquid flowing toward supply openings is higher than in other regions exists at the end portion side in the alignment direction of the supply openings (one direction). Then, when, during the maintenance, the liquid is expelled from a plurality of nozzles and the liquid expelling is stopped in the order of the first nozzle to the second nozzle, bubbles in the common liquid chamber are drawn toward where flows are generated. Because of this, bubbles in the common liquid chamber move toward the end portion and are led to a high-flow speed region. Since in a high-flow speed region, bubbles are more likely to be expelled than in other regions, movement of bubbles to a high-flow speed region of the end portion will improve the capability of expelling bubbles while minimizing the amount of the liquid expelled during the maintenance.

In the foregoing aspects of the invention, the liquid discharge apparatus may further include a driving element that generates in the pressure chambers a pressure for discharging the liquid from the nozzles and, during the maintenance, the controller may control expelling the liquid from the nozzles by driving the driving element so as to discharge the liquid from the nozzles. According to this construction, during the maintenance, the liquid is discharged and therefore expelled from nozzles by driving the driving element, so that bubbles in the common liquid chamber are moved to the end portion side and therefore are likely to be expelled.

In the foregoing aspects of the invention, the liquid discharge apparatus may further include a maintenance mechanism that sucks the liquid from the nozzles and, during the maintenance, the controller may control expelling the liquid from the nozzles by using the maintenance mechanism so that the liquid is sucked separately for each nozzle. According to this construction, during the maintenance, the liquid is discharged and therefore expelled from nozzles by using the maintenance mechanism, so that bubbles in the common liquid chamber are moved to the end portion side and therefore are likely to be expelled.

In the foregoing aspects of the invention, during the maintenance, the controller may control a first cleaning in which the liquid is expelled from a plurality of nozzles that include the first nozzle and the second nozzle and then may control a second cleaning in which the liquid is expelled from the plurality of nozzles so that each of the plurality of nozzles has a larger amount of the liquid expelled than each nozzle in the first cleaning. According to this construction, even if a bubble remains without being expelled in the first cleaning, the bubble can be expelled by the second cleaning. Furthermore, since the first cleaning is performed so that bubbles are moved to the end portions of the common liquid chamber that allow bubbles to be easily expelled before the second cleaning is performed, remaining bubbles will be more likely to be expelled than in the case where the second cleaning alone is performed. This further improves the capability of expelling bubbles present in the common liquid chamber.

A further aspect of the invention provides a maintenance method for a liquid discharge apparatus which performs a maintenance by expelling a liquid from a plurality of nozzles, the liquid discharge apparatus including a plurality of pressure chambers that generate a pressure for discharging a liquid, a plurality of nozzles that communicate individually with the pressure chambers arranged in one direction and that discharge the liquid from the pressure chambers, a common liquid chamber that includes a plurality of supply openings which are arranged along an arrangement of the pressure chambers and through which the liquid is supplied individually to the pressure chambers and that has, at an end portion side in an arrangement direction of the supply openings, a region in which flow speed of the liquid flowing toward the supply openings is higher than in another region, and a controller that controls the maintenance by expelling the liquid from the nozzles. The maintenance method includes expelling the liquid from a first nozzle that is one of nozzles from which the liquid is expelled during the maintenance and a second nozzle that is one of nozzles located on the end portion side of the first nozzle in the arrangement direction of the supply openings, in an order of the first nozzle to the second nozzle. According to this aspect, bubbles in the common liquid chamber are drawn by local flows to move toward the end portion, so that the bubbles are led to a high-flow speed region. Since in a high-flow speed region, bubbles are more likely to be expelled than in other regions, movement of bubbles to a high-flow speed region of the end portion will improve the capability of expelling bubbles while minimizing the amount of the liquid expelled during the maintenance.

A still further aspect of the invention provides a maintenance method for a liquid discharge apparatus which performs a maintenance by expelling a liquid from a plurality of nozzles, the liquid discharge apparatus including a plurality of pressure chambers that generate a pressure for discharging a liquid, a plurality of nozzles that communicate individually with the pressure chambers arranged in one direction and that discharge the liquid from the pressure chambers, a common liquid chamber that includes a plurality of supply openings which are arranged along an arrangement of the pressure chambers and through which the liquid is supplied individually to the pressure chambers and that has, at an end portion side in an arrangement direction of the supply openings, a region in which flow speed of the liquid flowing toward the supply openings is higher than in another region, and a controller that controls the maintenance by expelling the liquid from the nozzles. The maintenance method includes expelling the liquid from the plurality of nozzles and stopping expelling the liquid from a first nozzle that is one of nozzles from which the liquid is expelled during the maintenance and a second nozzle that is one of nozzles located on the end portion side of the first nozzle in the arrangement direction of the supply openings, in an order of the first nozzle to the second nozzle. According to this aspect, when, during the maintenance, the liquid is expelled from a plurality of nozzles and the liquid expelling is stopped in the order of the first nozzle to the second nozzle, bubbles in the common liquid chamber are drawn toward where flows are generated. Because of this, bubbles in the common liquid chamber move toward the end portion and are led to a high-flow speed region. Since in a high-flow speed region, bubbles are more likely to be expelled than in other regions, movement of bubbles to a high-flow speed region of the end portion will improve the capability of expelling bubbles while minimizing the amount of the liquid expelled during the maintenance.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Exemplary Embodiment

Figure 1:
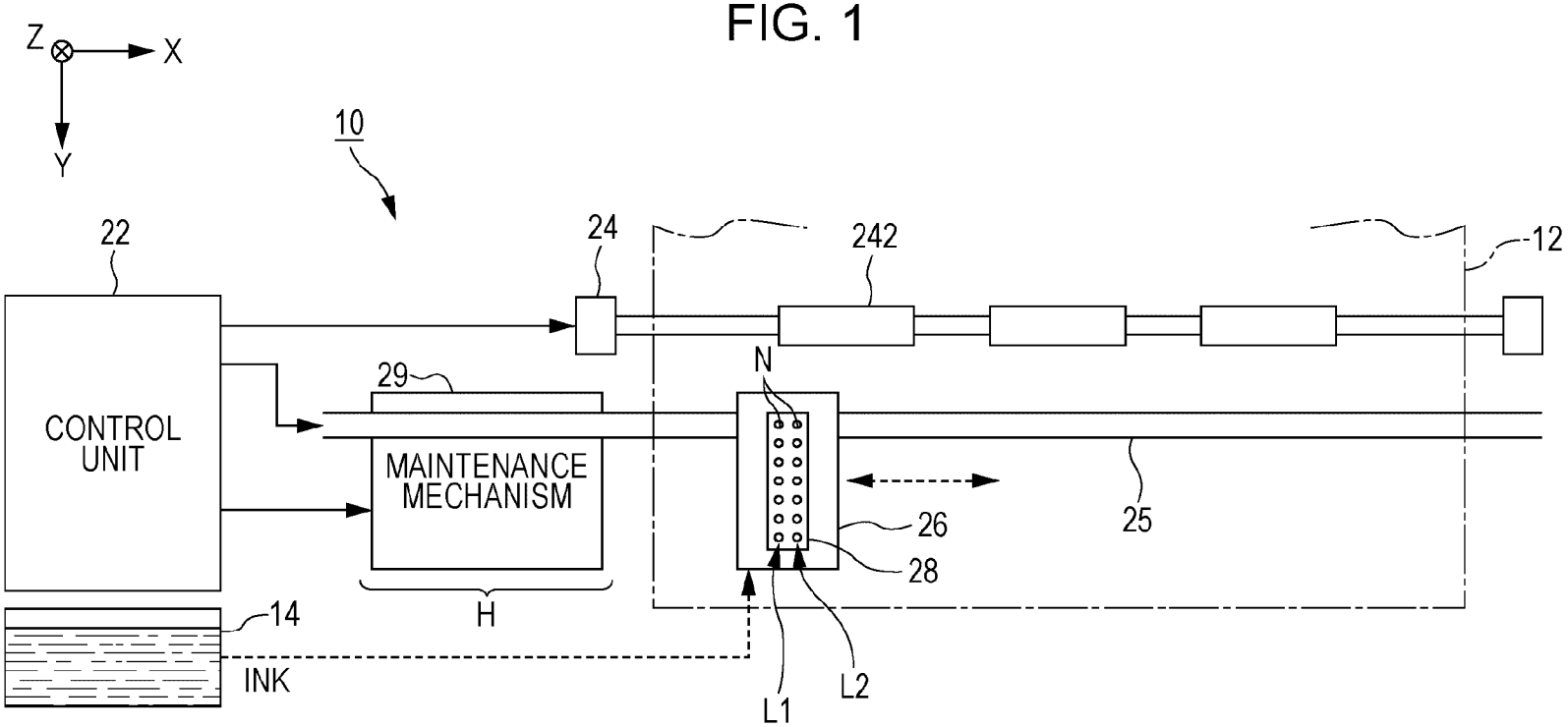
FIG. 1 is a partial construction diagram of a liquid discharge apparatus according to a first exemplary embodiment of the invention.

FIG. 1 is a partial construction diagram of a liquid discharge apparatus 10 according to a first exemplary embodiment of the invention. The liquid discharge apparatus 10 of the first exemplary embodiment is an ink jet type printing apparatus that discharges ink, an example of liquid, to a medium 12 such as a printing sheet. The liquid discharge apparatus 10 illustrated in FIG. 1 includes a controller 22, a transporting mechanism 24, a moving mechanism 25, a carriage 26, and a liquid discharge head 28. A liquid container (cartridge) 14 that stores ink is fitted to the liquid discharge apparatus 10.

The liquid container 14 is an ink tank type cartridge made up of a box-shaped container detachably attached to a main body of the liquid discharge apparatus 10. The liquid container 14 is not limited to a box-shaped container but may also be an ink pack type cartridge made up of a bag-shaped container. The liquid container 14 stores ink. The ink may be a black ink or may also be a color ink. The ink stored in the liquid container 14 is pumped to the liquid discharge head 28 by a pump (not depicted).

The controller 22 controls various components of the liquid discharge apparatus 10 in an overall manner. The controller 22 includes a CPU, a ROM, a RAM, etc. The ROM stores various programs such as a program for performing a printing operation which the CPU executes. Furthermore, the RAM is configured to temporarily stores results of computation by the CPU, various data that are processed by executing control programs, etc.

The transporting mechanism 24 is made up of transport rollers 242 and the like and transports a medium 12 in a Y direction under the control of the controller 22. Each liquid discharge head 28 is supplied with ink from the liquid container 14. Each liquid discharge head 28 discharges ink from a plurality of nozzles N to the medium 12 under the control of the controller 22.

The liquid discharge head 28 is mounted on the carriage 26. Although FIG. 1 illustrates an example of a construction in which one liquid discharge head 28 is mounted on the carriage 26, the invention is not limited to this construction but a plurality of liquid discharge heads 28 may be mounted on the carriage 26. The carriage 26 is a structural body that accommodates and supports the liquid discharge head 28. Under the control of the controller 22, the carriage 26 is repetitively moved back and forth along an X direction (second direction) that intersects the Y direction (first direction) by the moving mechanism 25. The moving mechanism 25 includes a transport belt, a motor, etc. Simultaneously with the transportation of the medium 12 by the transporting mechanism 24 and the repetitive back and forth movements of the carriage 26, the liquid discharge head 28 discharges ink to the medium 12 so that a desired image is formed on a surface of the medium 12. However, the construction of the transporting mechanism 24, the moving mechanism 25, and the carriage 26 is not limited to the forgoing example. Note that a direction perpendicular to the X-Y plane will be hereinafter termed a Z direction.

The liquid discharge apparatus 10 includes a maintenance mechanism 29 that performs maintenance of the liquid discharge head 28. The maintenance mechanism 29 includes a cap that seals (caps) a discharge surface to which the plurality of nozzles N have openings, a suction pump that sucks ink from the nozzles N by generating a negative pressure inside the sealed cap. The controller 22 executes a maintenance process of expelling bubbles having entered the liquid discharge head 28 by expelling ink from the nozzles N while discharge surface of the liquid discharge head 28 is capped with the cap of the maintenance mechanism 29. In this maintenance process, piezoelectric elements 385 described below are driven to discharge ink from the nozzles N, so that bubbles are expelled with flows of ink. The maintenance may be performed not only by discharging ink from nozzles N but also by expelling ink by sucking ink from nozzles N through the use of the suction pump of the maintenance mechanism. The above-described maintenance is executed when the liquid discharge head 28 is at a home position H.

Figure 2:
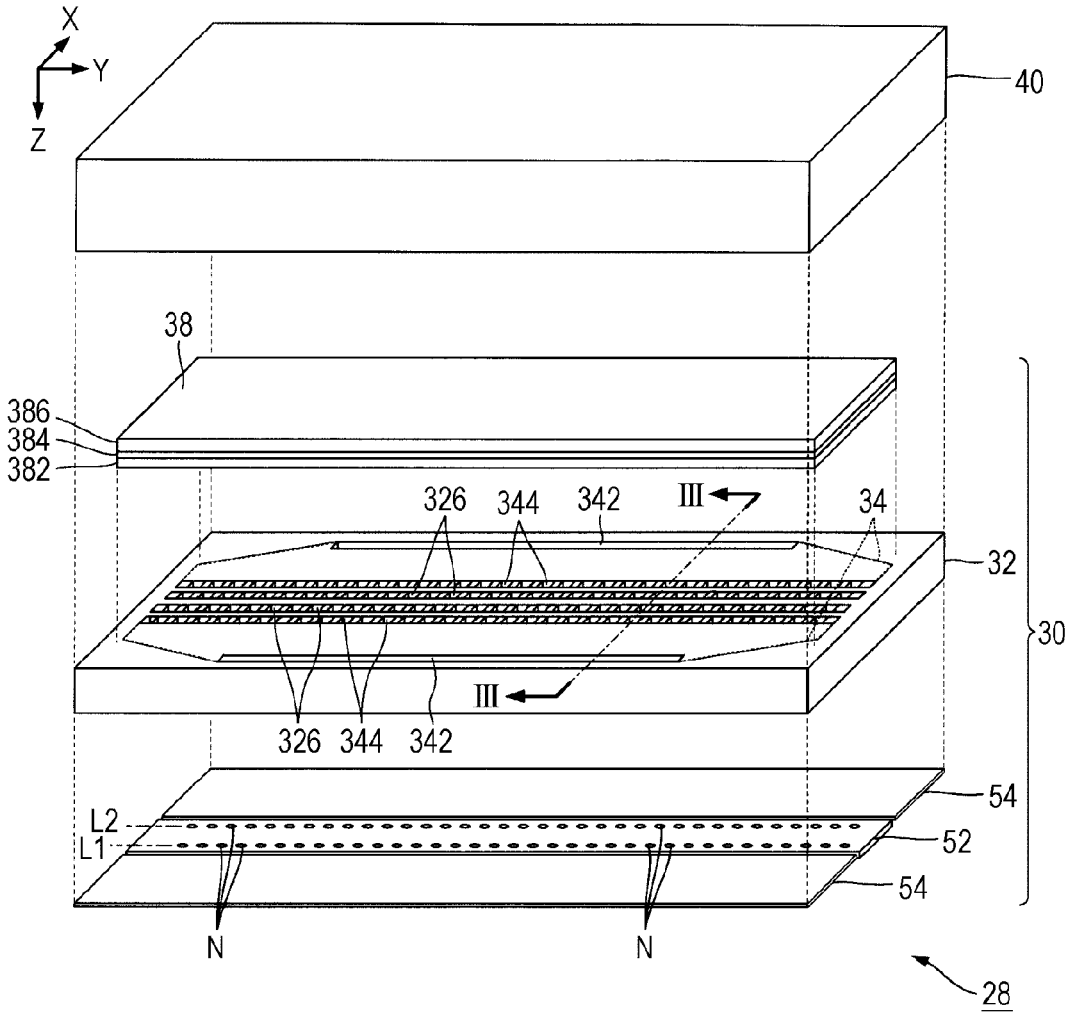
FIG. 2 is an exploded perspective view of a liquid discharge head.
Figure 3:
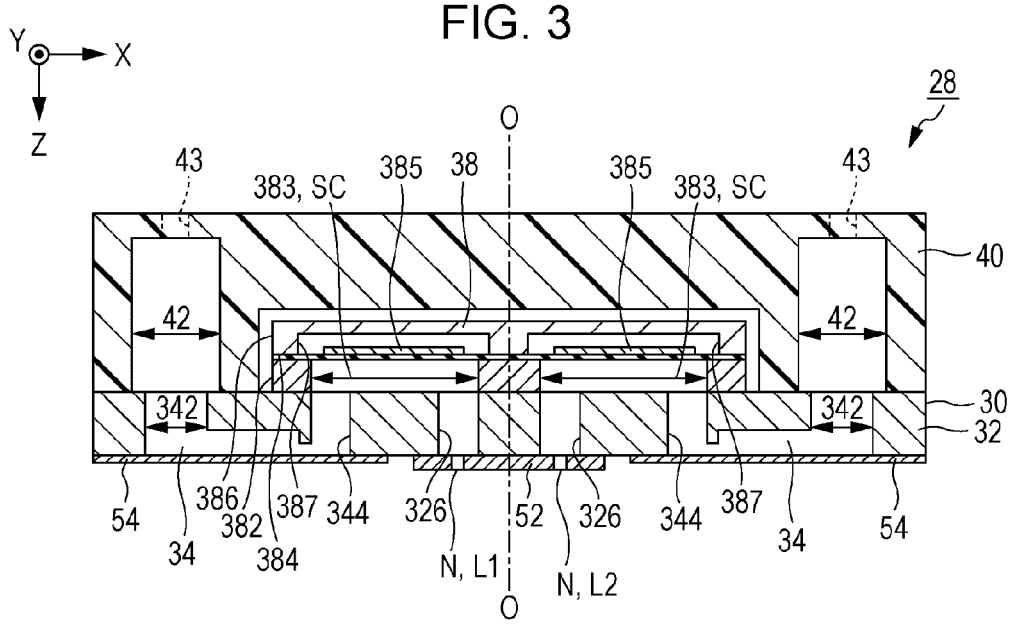
FIG. 3 is a sectional view of the liquid discharge head taken along line III-III in FIG. 2.

FIG. 2 is an exploded perspective view of the liquid discharge head 28. FIG. 3 is a sectional view of the liquid discharge head 28 taken on line III-III in FIG. 2. As shown in FIG. 2 and FIG. 3, the liquid discharge head 28 is constructed by fixing (joining) the case member 40 to a head body 30 that has a discharge surface in which nozzles N for discharging ink are formed. The head body 30 is a structural body that includes a flow path substrate 32. One side surface of the flow path substrate 32 (a positive Z direction-side surface thereof) is provided with closure plates (compliance substrates) 54 and a nozzle plate 52 in which the plurality of nozzles N are formed. On the opposite side surface of the flow path substrate 32 (a negative Z direction-side surface thereof) there is stacked a stack unit 38 that includes a pressure chamber substrate 382. These components of the head body 30 are fixed to each other, for example, with an adhesive.

The nozzle plate 52 is a flat plate member that forms the discharge surface in which the nozzles N are formed and aligned in the Y direction (first direction). The nozzle plate 52 is made of, for example, a silicon material. The nozzles N form two nozzle rows L1 and L2. The nozzle rows L1 and L2 are each a set of a plurality of nozzles N aligned along the Y direction. The arrangement of the nozzle rows L1 and L2 is not limited to what is depicted in conjunction with this exemplary embodiment. For example, the nozzle rows L1 and L2 may be shifted from each other in the Y direction. Furthermore, the row arrangement of nozzles formed in the nozzle plate 52 is not limited to a two-row arrangement but may also be a one-row arrangement.

Figure 4:
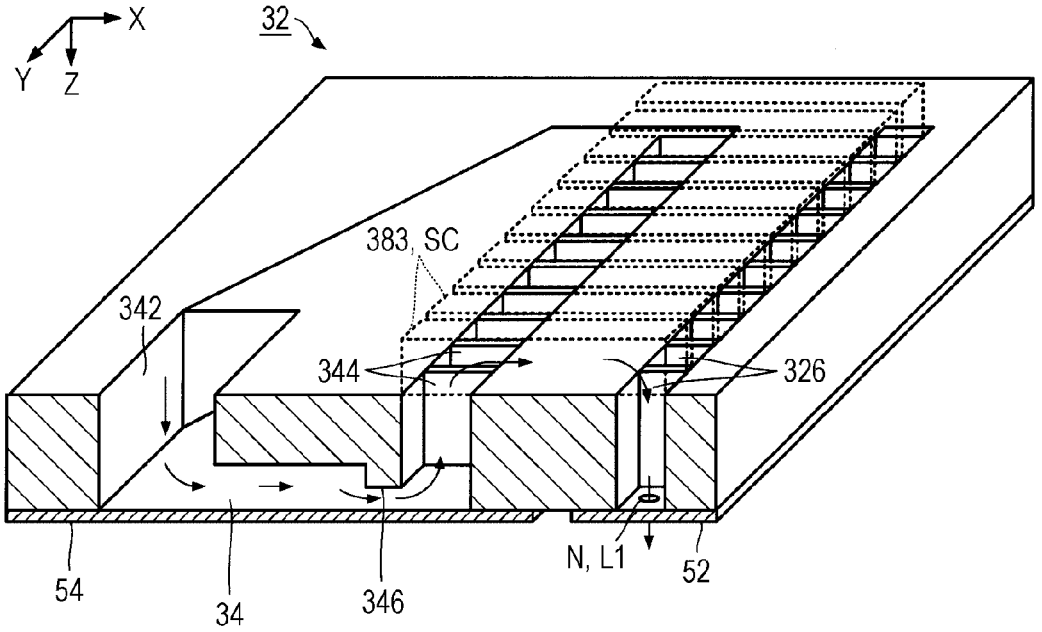
FIG. 4 is a partial perspective view of a flow path substrate with a sectioned surface.

In the liquid discharge head 28 according to this exemplary embodiment, a structure (a left-side portion in FIG. 3) that corresponds to the nozzle row L1 and a structure (a right-side portion in FIG. 3) that corresponds to the nozzle row L2 are formed substantially axially symmetrically with respect to an imaginary line O-O in the X direction. The two structures are substantially the same. Therefore, the following description focuses on the structure that corresponds to the nozzle row L1 (a portion on the left side of the imaginary line O-O in FIG. 3) and omits components and elements that correspond to the nozzle row L2 for the sake of convenience. FIG. 4 is a partial perspective view with a sectioned surface of the structure corresponding to the nozzle row L1. In FIG. 4, a plurality of pressure chambers SC are illustrated by interrupted lines.

The flow path substrate 32 illustrated in FIGS. 2 to 4 is a flat plate member that forms flow paths of ink. The flow path substrate 32 is formed from, for example, a silicon material. The flow path substrate 32 is provided with a common liquid chamber 34 and a plurality of communication flow paths 326. The common liquid chamber 34 has an inlet opening 342 through which ink flows in and a plurality of supply openings 344. The supply openings 344 and the communication flow paths 326 are through holes formed separately for each of the nozzles N while the common liquid chamber 34 is an opening common to the plurality of nozzles N.

The closure plates 54 are each a flexible film and functions as a vibration absorber that absorbs pressure changes of ink in the common liquid chamber 34. As illustrated in FIG. 3, the closure plates 54 seal the common liquid chamber 34 and form a bottom surface of the common liquid chamber 34. Although FIG. 3 illustrates a construction in which the common liquid chamber 34 corresponding to the nozzle row L1 and the common liquid chamber 34 corresponding to the nozzle row L2 are sealed by separate closure plates 54, the invention is not limited to this construction. For example, one closure plate 54 may continuously extend so as to seal the two common liquid chambers 34.

The stack unit 38 has been formed by stacking the pressure chamber substrate 382 that forms pressure chambers SC that communicate with the nozzles N, a vibration plate 384, and a protective plate 386 in this order. However, the invention is not limited to this construction. For example, the stack unit 38 may be provided without the protective plate 386. The pressure chamber substrate 382 is provided with a plurality of opening portions 383 that each form a pressure chamber SC (cavity) that communicates with one of the nozzles N. The pressure chamber substrate 382 is formed from, for example, a silicon material as is the case with the flow path substrate 32.

An opposite side surface of the pressure chamber substrate 382 to the flow path substrate 32 is provided with the vibration plate 384. The vibration plate 384 is a flat plate member that can be elastically vibrated. The vibration plate 384 and the flow path substrate 32 face each other across a distance through the opening portions 383 formed in the pressure chamber substrate 382. Each of spaces inside the opening portions 383 of the pressure chamber substrate 382 sandwiched between the flow path substrate 32 and the vibration plate 384 forms a pressure chamber SC in which a pressure for discharging ink from a corresponding one of the nozzles N is generated. The supply openings 344 of the flow path substrate 32 provide communication between the common liquid chamber 34 (described below) and the pressure chambers SC. The communication flow paths 326 of the flow path substrate 32 provide communication between the pressure chambers SC and the nozzles N.

The opposite side surface of the vibration plate 384 to the pressure chamber substrate 382 is provided with a plurality of piezoelectric elements 385 that individually correspond to different nozzles N (different pressure chambers SC). Each piezoelectric element 385 is a driving element in which a piezoelectric body is interposed between two electrodes facing each other. The piezoelectric elements 385 individually vibrates upon drive signals supplied from the controller 22. The protective plate 386 is a component that protects the piezoelectric elements 385 and is fixed to the surface of the pressure chamber substrate 382 (the vibration plate 384) by, for example, an adhesive. A vibration plate 384-side surface of the protective plate 386 has recess portions 387 that house the piezoelectric elements 385. When a piezoelectric element 385 vibrates in response to a drive signal supplied from the controller 22, the vibration plate 384 vibrates correspondingly to the piezoelectric element 385. This changes the pressure of ink in the pressure chamber SC so that the nozzle N discharges ink. Thus, the piezoelectric elements 385 function as pressure-generating elements that change the pressure inside the pressure chambers SC so that ink inside the pressure chambers SC is discharged from the nozzles N.

A positive Z direction-side surface of a case member 40 (hereinafter, referred to as "junction surface") is fixed to a negative Z direction-side surface of the flow path substrate 32 by, for example, an adhesive. The case member 40 is formed from a resin molding material, for example, a plastic material or the like. When the case member 40 is formed from a resin molding material, the case member 40 can be unitarily molded by injection molding of a resin molding material. The case member 40 is a case for storing ink that is to be supplied to the plurality of pressure chambers SC and is a structural body that has a liquid storage chamber 42 that communicates with the common liquid chamber 34 via the inlet opening 342. The liquid storage chamber 42 communicates with an introduction port 43 through which ink is introduced.

The common liquid chamber 34 and the liquid storage chamber 42 form a space common to the plurality of nozzles N and store ink supplied from the liquid container 14 through the introduction port 43. As illustrated in FIG. 4, ink flows from the liquid storage chamber 42 into the common liquid chamber 34, branches into the plurality of supply openings 344, and is supplied in parallel to the pressure chambers SC, so that ink fills the pressure chambers SC. Then, due to pressure changes in a pressure chamber SC according to vibrations of the vibration plate 384, ink inside the pressure chamber SC is discharged out from the pressure chamber SC through the communication flow path 326 and the nozzle N. That is, the pressure chambers SC function as spaces in which a pressure for discharging ink from the nozzles N is generated and the common liquid chamber 34 and the liquid storage chamber 42 function as a space (reservoir) that stores ink that is to be supplied to the plurality of pressure chambers SC.

Figure 5:
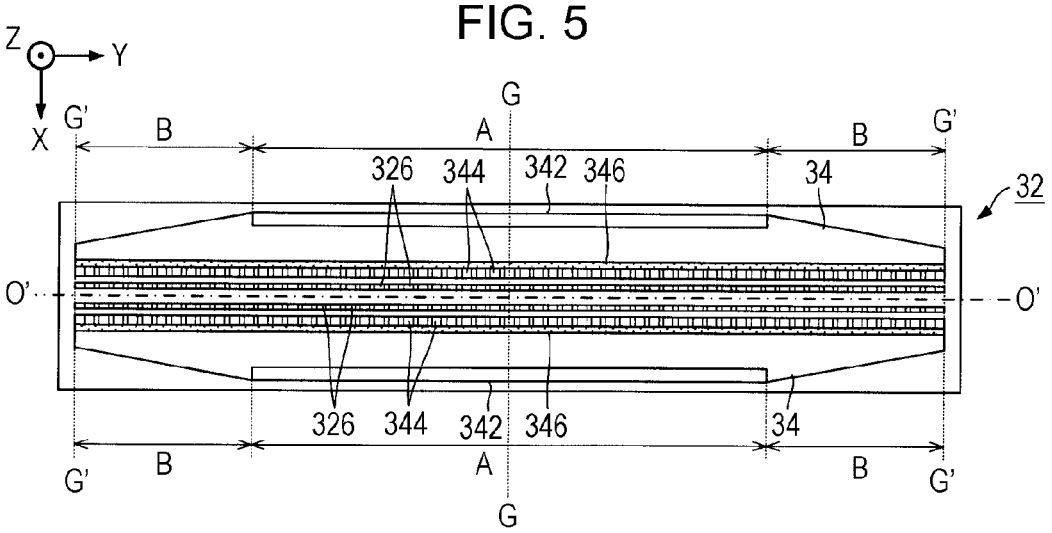
FIG. 5 is a bottom plan view of the flow path substrate.
Figure 6:
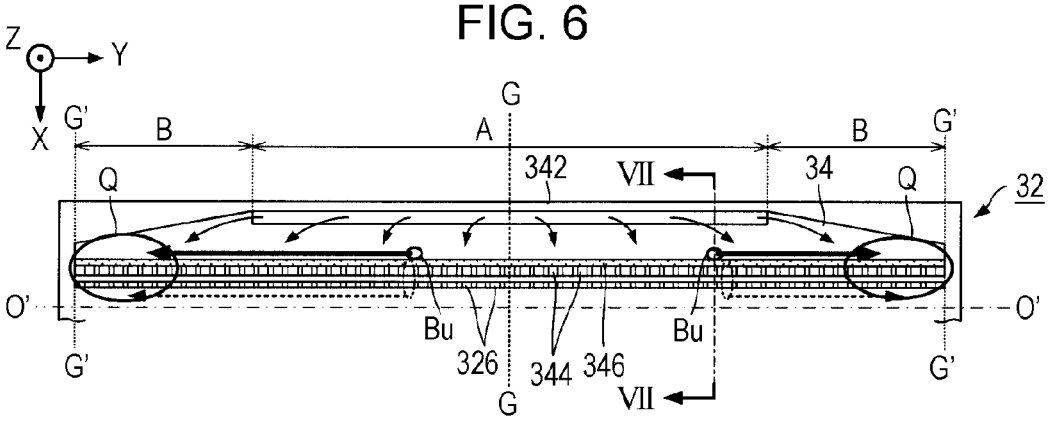
FIG. 6 is a partial plan view of the flow path substrate.
Figure 7:
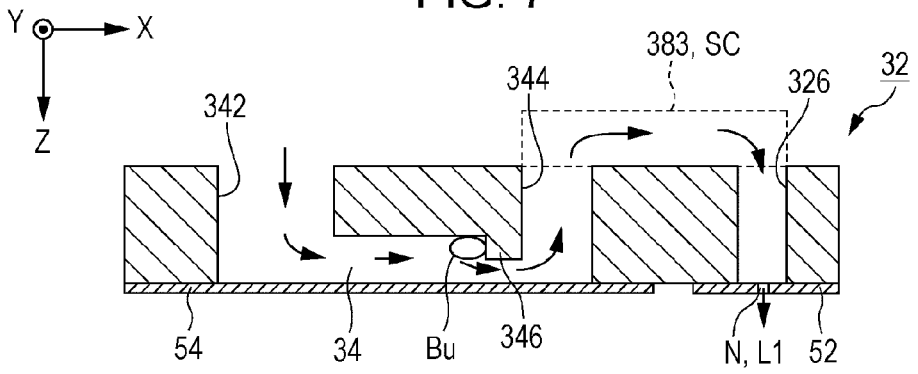
FIG. 7 is a sectional view of the flow path substrate taken along line VII-VII in FIG. 6.

FIG. 5 is a plan view of the flow path substrate 32 taken from the negative side in the Z direction (from below). The flow path substrate 32 is provided with a structure that corresponds to the nozzle row L1 (an upper portion in FIG. 5) and a structure that corresponds to the nozzle row L2 (a lower portion in FIG. 5) that are substantially axially symmetrical with respect to an imaginary line O'-O' in the Y direction and substantially the same. Therefore, the following description focuses on the structure that corresponds to the nozzle row L1 (the portion on the upper side of the imaginary line O'-O' in FIG. 5) and omits components that correspond to the nozzle row L2 for the sake of convenience. FIG. 6 is a partial plan view of the flow path substrate 32, illustrating flows of ink in the structure that corresponds to the nozzle row L1. FIG. 7 is a sectional view of the flow path substrate 32 taken on line VII-VII in FIG. 6. FIG. 7 shows a drawing that corresponds to the sectioned surface illustrated in FIG. 4. FIG. 7, similar to FIG. 4, illustrates a pressure chamber SC by an interrupted line, together with the nozzle plate 52 and the closure plate 54.

As illustrated in FIGS. 5 and 6, the common liquid chamber 34 is formed by a space elongated in the Y direction. When the common liquid chamber 34 is divided into a first region A that includes a central portion G in the alignment direction of the supply openings 344 (in the Y direction) and second regions B located at end portion G' sides, the inlet opening 342 is disposed at a side in the first region A in the X direction and the supply openings 344 are disposed in a region that is located at the other side in the X direction and that extends through the first region A and the two second regions B on both sides of the first region A. That is, the supply openings 344 do not need to be confined only in the first region A. For example, supply openings 344 located at both ends in the Y direction may be located in the second regions. Furthermore, although this exemplary embodiment has been described in conjunction with an example in which one inlet opening 342 elongated in the Y direction of the first region A is formed, the invention is not limited to this example. For example, a plurality of inlet openings 342 arranged in the Y direction of the first region A may be formed.

As illustrated in FIG. 4, the pressure chambers SC are aligned in one direction (the Y direction) and the supply openings 344 are aligned in the Y direction along the alignment of the pressure chambers SC. As illustrated in FIGS. 4 and 7, the common liquid chamber 34 in this exemplary embodiment is provided with a projected portion 346 that narrows portions of flow paths immediately upstream of entrances to the supply openings 344. The projected portion 346 protrudes from a negative Z direction-side inner wall that partially defines a space of the common liquid chamber 34 into the space of the common liquid chamber 34. As illustrated in FIGS. 5 and 6, the projected portion 346 extends continuously in the Y direction along the alignment of the supply openings 344. The projected portion 346 increases the flow speed of ink entering the supply openings 344. Furthermore, when the projected portion 346 is provided, an equal-diameter portion of the flow path through each supply opening 344 can be prevented from becoming inconveniently short even if a supply opening 344-side edge portion chips off, in comparison with when the projected portion 346 is not provided. Although the exemplary embodiment has been described in conjunction with an example in which the common liquid chamber 34 is provided with the projected portion 346, the projected portion 346 may also be omitted.

The common liquid chamber 34 in the exemplary embodiment has such a shape that the flow path gradually expands from the inlet opening 342 side to the supply opening (outlet opening) 344 side. That is, the common liquid chamber 34 is larger in cross-sectional area (Y-Z section) at the supply openings 344 than at the inlet opening 342 side. The common liquid chamber 34 is oblique from the first region A, which includes the central portion G, toward the end portions G' of the second regions B on both sides of the first region A so that the common liquid chamber 34 gradually expands from the inlet opening 342 side to the supply opening 344 side. Therefore, in each second region B, the flow path gradually becomes narrower toward the end portion G'. That is, each second region B has smaller cross-sectional areas (X-Z sections) than the first region A and gradually becomes smaller in cross-sectional area (X-Z section) toward the end portion G'.

To further describe the shape of the common liquid chamber 34, a width (first width) of the common liquid chamber 34 in a direction (Y direction) measured at a location at which the inlet opening 342 is formed is smaller than a width (second width) of the common liquid chamber 34 in the Y direction measured at a location at which the supply openings (outlet openings) 344 are formed. In the Z direction, the common liquid chamber 34 has a substantially uniform width. However, it should be noted that the width of the common liquid chamber 34 in the Z direction may increase or decrease. In any case, there is an upper-limit restriction that the width of the common liquid chamber 34 in the Z direction cannot be made larger than the thickness of the flow path substrate 32 in the Z direction, which is smaller than the width of the flow path substrate 32 in the Y direction. Therefore, the influence that the width of the common liquid chamber 34 in the Z direction has on the flow speed in each second region B is small and limited.

According to the common liquid chamber 34 having a shape as described above, ink flowing in through the inlet opening 342 spreads from the first region A to a wide region that includes the second regions B on both sides, forming flows of ink that move into the supply openings 344 as indicated by thinner-line arrows in FIG. 6. In this process, since the flow path in each second region B gradually becomes narrower toward the end portion G', the flow speed of ink in each second region B gradually becomes faster toward the end portion G'. Therefore, a region in each second region B near its end portion G' is a region (high-flow speed region Q) in which the flow speed of ink is higher than in other regions (e.g., the first region A).

By the way, a bubble Bu entering the common liquid chamber 34 will cause incomplete discharge of ink, decreasing the print quality. Therefore, the liquid discharge head 28 is subjected to a maintenance process of expelling bubbles Bu from the common liquid chamber 34. If a maintenance process of sucking ink from the nozzles N with the discharge surface sealed (capped) by the cap of the maintenance mechanism 29, there occur flows of ink that move in through the inlet openings 342 and move toward the supply openings 344 as indicated by arrows in FIG. 7. Therefore, bubbles Bu in the common liquid chamber 34 move carried with flows of ink. If a bubble Bu moves beyond the projected portion 346 and closes the entrance of a supply opening 344, the negative pressure on a downstream side of the supply opening 344 increases. Therefore, the bubble Bu is sucked into the supply opening 344 and expelled from the nozzle N together with ink. With regard to supply openings 344 in the high-flow speed regions Q in the second regions B at the end portion G' sides, in particular, bubbles Bu are easily expelled because of higher flow speeds.

However, in a portion other than the end portion G'-side second region B, for example, in the central portion G-side first region A, the flow speed is lower than in the end portion G'-side second region B and such a flow speed that a bubble Bu closes a supply opening 344 cannot be obtained. Therefore, in the central portion G-side first region A, bubbles Bu tend to reside. Particularly, in a structure in which the projected portion 346 is provided as illustrated in FIG. 7, since a portion of the flow path immediately upstream of entrance into the supply openings 344 is narrow, bubbles Bu are highly likely to reside without being able to move beyond the projected portion 346. Then, bubbles Bu are all the more unlikely to close supply openings 344, so that the capability to expel bubbles Bu is low.

Therefore, in this exemplary embodiment, the liquid discharge apparatus does not simultaneously expel ink from all the nozzles N during maintenance but switches nozzles N from which to expel ink during maintenance sequentially from the central portion G side to the end portion G' sides. This forms local flows that draw bubbles Bu to supply openings 344 and shifts such local flows from the central portion G side to the end portion G' sides. According to this maintenance process, as illustrated by thick-line arrows in FIG. 6, bubbles Bu can be moved to the high-flow speed region Q of each second region B in which bubbles Bu are more easily expelled. Therefore, the capability of expelling bubbles Bu having entered the common liquid chamber 34 can be improved.

Concretely, as illustrated in FIG. 6, on the negative Y direction side (the left side in FIG. 6) of the central portion G of the common liquid chamber 34, nozzles N from which to expel ink during maintenance are sequentially switched from the central portion G side to the end portion G' side in the negative Y direction. Therefore, when a local flow is caused from a portion enclosed by a dotted-line ellipse (smaller ellipse) on the left side in FIG. 6, such a local flow is shifted to the negative Y direction side as indicated by a dotted-line arrow. Hence, a bubble Bu moves toward the negative Y direction-side end portion G' as indicated by a thick-line arrow in FIG. 6.

On the positive Y direction side (the right side in FIG. 6) of the central portion G of the common liquid chamber 34, nozzles N from which to expel ink during maintenance are sequentially switched from the central portion G side to the end portion G' side in the positive Y direction. Therefore, when a local flow is caused from a portion enclosed by a right-side dotted-line ellipse (smaller ellipse) in FIG. 6, such a local flow is shifted to the positive Y direction side as indicated by a dotted-line arrow. Hence, a bubble Bu moves toward the right-side end portion G' in the Y direction as indicated by a thick-line arrow in FIG. 6.

Such a maintenance method in the first exemplary embodiment will be concretely described below. In this exemplary embodiment, maintenance is executed by the controller 22. For example, the controller 22 periodically starts a maintenance process every time the time of use or the number of times of use of the liquid discharge apparatus 10 reaches a predetermined value. The maintenance process may also be started every time a predetermined number of printing media 12 have been subjected printing. Furthermore, the maintenance process may also be started according to an instruction from a user. The maintenance process in the exemplary embodiment is executed while the discharge surface of the liquid discharge head 28 is capped (covered) by the cap of the maintenance mechanism 29.

Figure 8A:
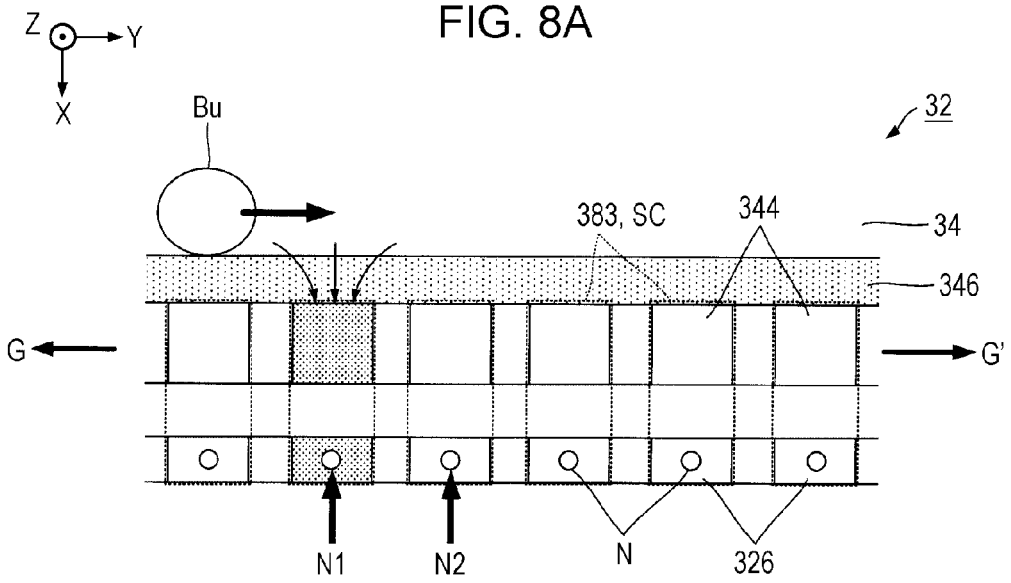
FIG. 8A is a diagram illustrating operation of a maintenance method according to the first exemplary embodiment.
Figure 8B:
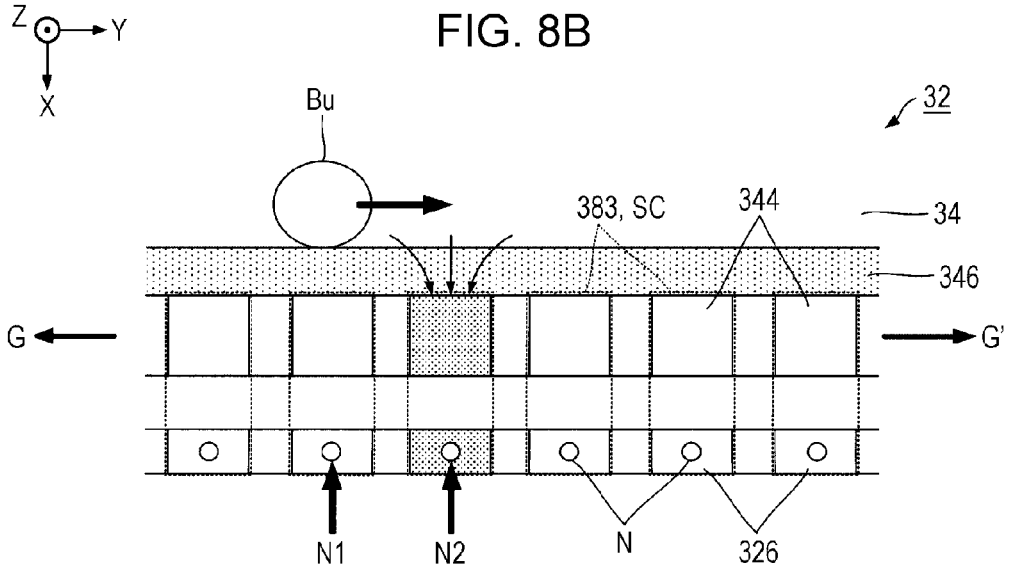
FIG. 8B is an operation-illustrating diagram continuing from FIG. 8A.

FIG. 8A and FIG. 8B are operation-illustrating diagrams regarding the maintenance process in the first exemplary embodiment. FIG. 8A and FIG. 8B each show an enlarged diagram of a few of the supply openings 344 shown in FIG. 6 which are located at the positive Y direction side of the central portion G. In FIG. 8A and FIG. 8B, the supply opening 344 and the communication flow path 326 of a nozzle N that is expelling ink is indicated by dot hatching. One of nozzles N from which the expel ink during the maintenance process in this exemplary embodiment is termed a first nozzle N1 and one of the nozzles N located at the end portion G' side of the first nozzle N1 in the alignment direction of the supply openings 344 is termed a second nozzle N2.

In the maintenance process of this exemplary embodiment, the controller 22 controls expelling ink from nozzles N sequentially from the first nozzle N1 to the second nozzle N2. In this exemplary embodiment, the controller 22 performs a flushing process of expelling ink by driving the piezoelectric elements 385 to discharge ink from the nozzles N. FIG. 8A illustrates a state in which ink is expelled from the first nozzle N1. FIG. 8B illustrates a state in which ink is expelled from the second nozzle N2 subsequently from the state illustrated in FIG. 8A.

As illustrated in FIG. 8A and FIG. 8B, local flows (thinner-line arrows) that draw a bubble Bu are produced in the common liquid chamber 34 in the order of the supply opening 344 that communicates with the pressure chamber SC of the first nozzle N1 to the supply opening 344 that communicates with the pressure chamber SC of the second nozzle N2. Since the second nozzle N2 is located at the end portion G' side of the first nozzle N1, local flows in the common liquid chamber 34 sequentially shift in a switching manner toward the end portion G'.

By switching nozzles N from which to expel ink in the maintenance process sequentially from the central portion G to the end portion G' as described above, the bubble Bu in the common liquid chamber 34 is drawn by local flows to move in the positive Y direction toward the end portion G' so that the bubble Bu is led to the high-flow speed region Q. Since bubbles Bu are more likely to be expelled in the high-flow speed region Q than in the other regions, the foregoing movement of bubbles Bu to a region of the end portion G' where the flow speed is high will improve the capability of expelling bubbles Bu while minimizing the amount of ink expelled during the maintenance process.

As illustrated in FIG. 8A and FIG. 8B, the nozzles N (that include the first nozzle N1 and the second nozzle N2) from which ink is expelled during the maintenance process of the exemplary embodiment are mutually adjacent nozzles. This reduces intervals between local flows generated in the common liquid chamber 34. Therefore, bubbles Bu can be easily moved to the end portion G' side even when in a region with low flow speed (e.g., the first region A).

Furthermore, in the maintenance process of the exemplary embodiment, a first cleaning in which ink is expelled from nozzles N that include the first nozzle N1 and the second nozzle N2 may be followed by a second cleaning in which ink is expelled from the nozzles N in such a manner that the amount of discharged from each one of the nozzles N is larger during the second cleaning than during the first cleaning. According to this, even if a bubble remains without being expelled by the first cleaning, that bubble can be expelled by the second cleaning. Furthermore, since the first cleaning is performed so that bubbles are moved to the end portions G' of the common liquid chamber that allow bubbles to be easily expelled before the second cleaning is performed, remaining bubbles will be more likely to be expelled than in the case where the second cleaning alone is performed. This further improves the capability of expelling bubbles from inside the common liquid chamber.

In an example of the second cleaning, nozzles N are capped by the cap of the maintenance mechanism 29 and ink is sucked from all the nozzles N. However, the second cleaning is not limited to this. For example, the capping and ink suction can be performed only on the nozzles N in the end portion G'-side second regions B of the common liquid chamber 34 or the nozzles N in the high-flow speed regions Q. Since bubbles are moved to the end portion G' sides in the common liquid chamber 34 by the first cleaning, it is highly likely that, after the first cleaning, bubbles, if any remain, are residing in or near the second regions B or the high-flow speed regions Q. By sucking ink only from the nozzles N in certain regions in which bubbles are highly likely to remain (e.g., the second regions B or the high-flow speed regions Q), the amount of ink expelled can be restrained in the second cleaning as well.

First Modification of First Exemplary Embodiment

Figure 9A:
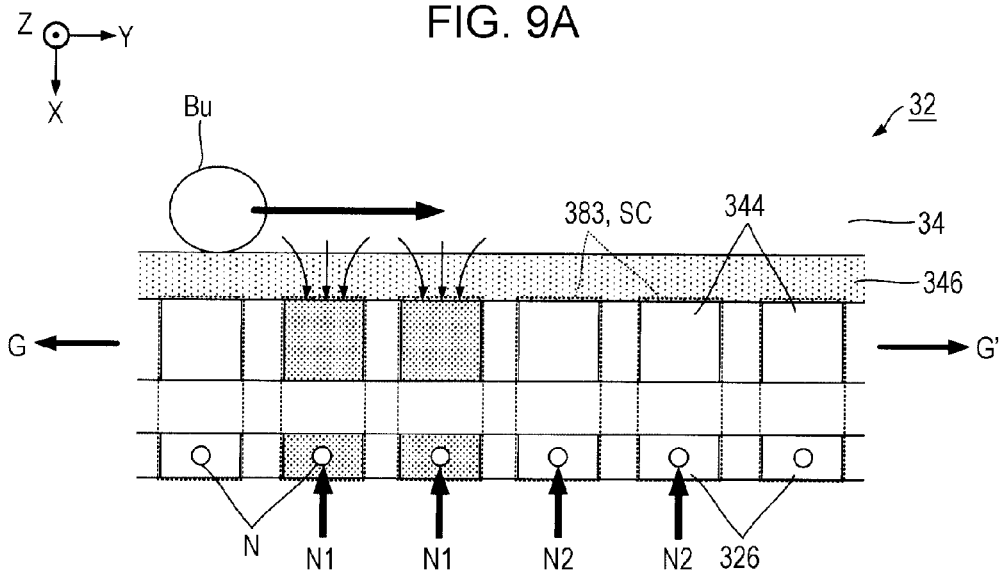
FIG. 9A is an operation-illustrating diagram regarding a first modification of the maintenance method of the first exemplary embodiment.
Figure 9B:
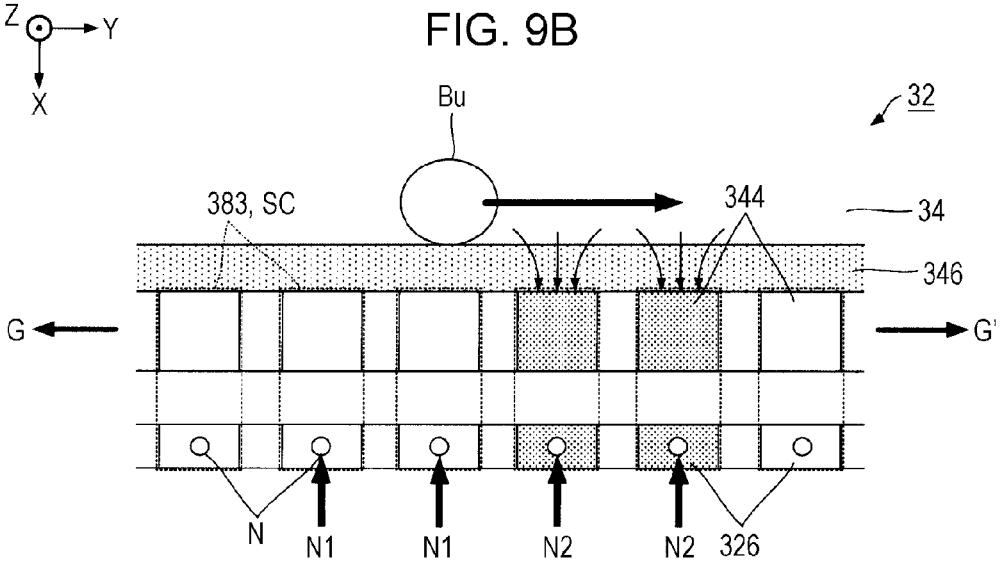
FIG. 9B is an operation-illustrating diagram continuing from FIG. 9A.

FIG. 9A and FIG. 9B are operation-illustrating diagrams regarding a first modification of the maintenance method of the first exemplary embodiment and correspond to FIG. 8A and FIG. 8B. FIG. 9A illustrates a state in which ink is expelled from first nozzles N1 in the first modification. FIG. 9B illustrates a state in which ink is expelled from second nozzles N2 in the first modification subsequently to the ink expelling illustrated in FIG. 9A. Components and the like in modifications described below as examples which are substantially the same in operation and function as the components and the like described above will be represented by reference characters used for those in the description of FIG. 8A and FIG. 8B and will be omitted from detailed description below as appropriate.

In a maintenance process according to the first modification illustrated in FIG. 9A and FIG. 9B, the manner in which ink is discharged from nozzles N is different from that in the foregoing maintenance process while the arrangement of the supply openings 344 is the same as illustrated in FIG. 8A and FIG. 8B. The nozzles N from which ink is expelled in the maintenance process according to the first modification include mutually adjacent first nozzles N1 and mutually adjacent second nozzles N2. Specifically, in the maintenance process according to the first modification illustrated in FIG. 9A and FIG. 9B, ink is expelled from a plurality of nozzles N at a time. FIG. 9A and FIG. 9B illustrate an example in which ink is expelled from two nozzles N at a time. According to the first modification described above, ink expelling is switched sequentially from the central portion G side to the end portion G' side while ink expelling is performed on a plurality of nozzles N at a time, so that, in the common liquid chamber 34, local flows are generated through a plurality of supply openings 344 at a time. Therefore, the moving speed of bubbles Bu can be increased. Incidentally, ink may also be expelled from three or more nozzles N at a time.

Second Modification of First Exemplary Embodiment

Figure 10A:
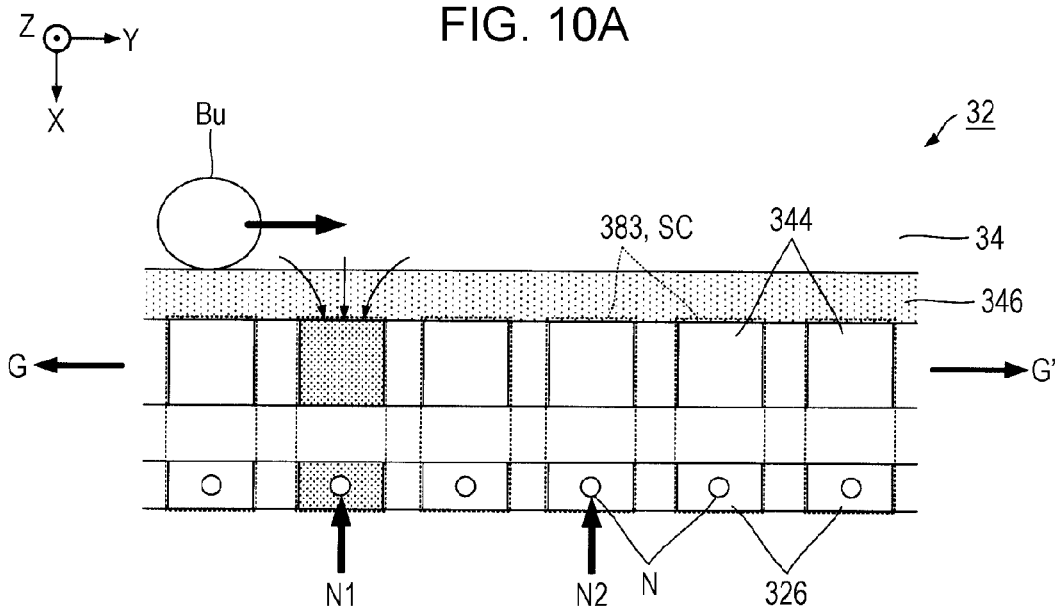
FIG. 10A is an operation-illustrating diagram regarding a second modification of the maintenance method of the first exemplary embodiment.
Figure 10B:
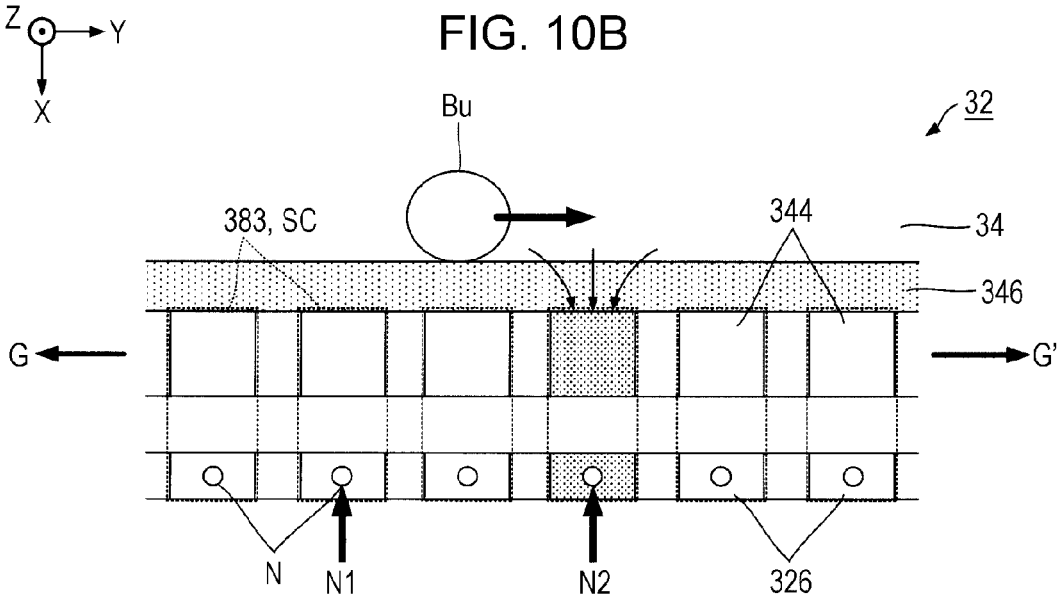
FIG. 10B is an operation-illustrating diagram continuing from FIG. 10A.

FIG. 10A and FIG. 10B are operation-illustrating diagrams regarding a second modification of the maintenance method of the first exemplary embodiment and correspond to FIG. 8A and FIG. 8B. FIG. 10A illustrates a state in which ink is expelled from a first nozzle N1 in the second modification. FIG. 10B illustrates a state in which ink is expelled from a second nozzle N2 in the second modification subsequently to ink expelling illustrated in FIG. 10A.

In a maintenance process according to the second modification illustrated in FIG. 10A and FIG. 10B, the manner in which ink is discharged from nozzles N is different from that in the foregoing maintenance process while the arrangement of the supply openings 344 is the same as illustrated in FIG. 8A and FIG. 8B. A first nozzle N1 and a second nozzle N2 from which ink is expelled in the maintenance process according to the second modification are so-called non-contiguous nozzles that are separated from each other by one nozzle. That is, in the maintenance process of the second modification illustrated in FIG. 10A and FIG. 10B, ink is expelled from a set of nozzles N separated from each other by at least one nozzle. According to the second modification described above, the intervals between local flows generated through the supply openings 344 in the common liquid chamber 34 can be made longer than in the case where ink is expelled from adjacent (contiguous) nozzles N. Therefore, bubbles Bu in a region in which the flow speed is fast (e.g., the second regions B) are more likely to be moved to the end portion G' sides. Although FIG. 10A and FIG. 10B illustrate an example in which ink is expelled from nozzles that are separated from each other by one nozzle, ink may also be expelled from nozzles that are separated from each other by two or more nozzles.

Furthermore, as for the nozzles N from which ink is expelled in the maintenance process of the second modification, the intervals between the non-contiguous nozzles N in the second regions B may be longer than the intervals between the non-contiguous nozzles N in the first region A. In the present exemplary embodiment, the flow speed is higher in the end portion G'-side second regions B in the common liquid chamber 34 than in the central portion G-side first region A therein. Therefore, although the intervals between the nozzles N from which ink is expelled in the maintenance process are longer in the second regions B than in the first region A, bubbles can be sufficiently moved. This achieves an overall reduction of the amount of ink expelled during maintenance.

Third Modification of First Exemplary Embodiment

Figure 11A:
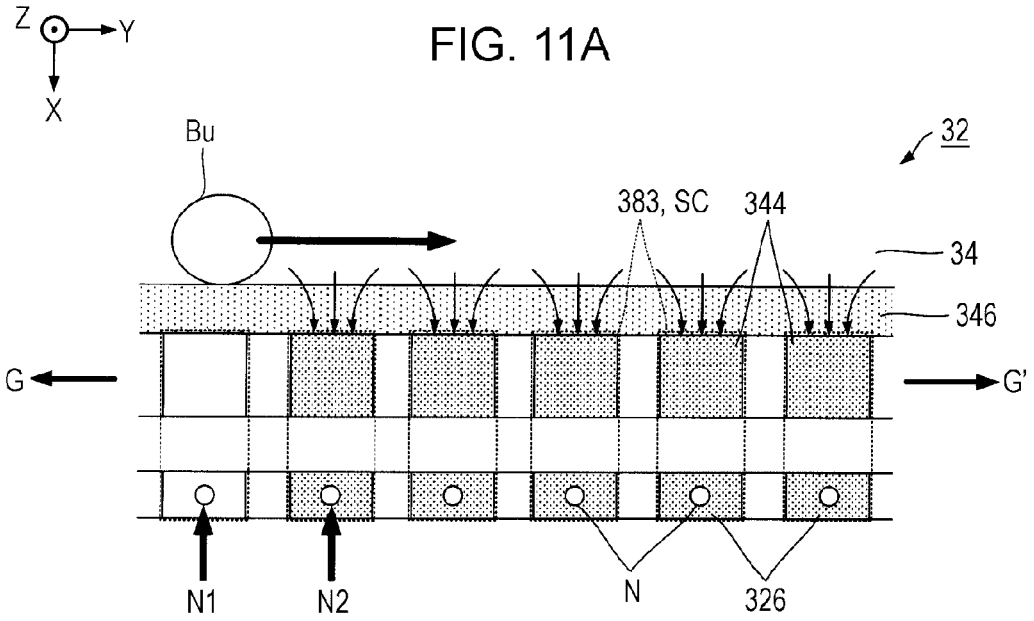
FIG. 11A is an operation-illustrating diagram regarding a third modification of the maintenance method of the first exemplary embodiment.
Figure 11B:
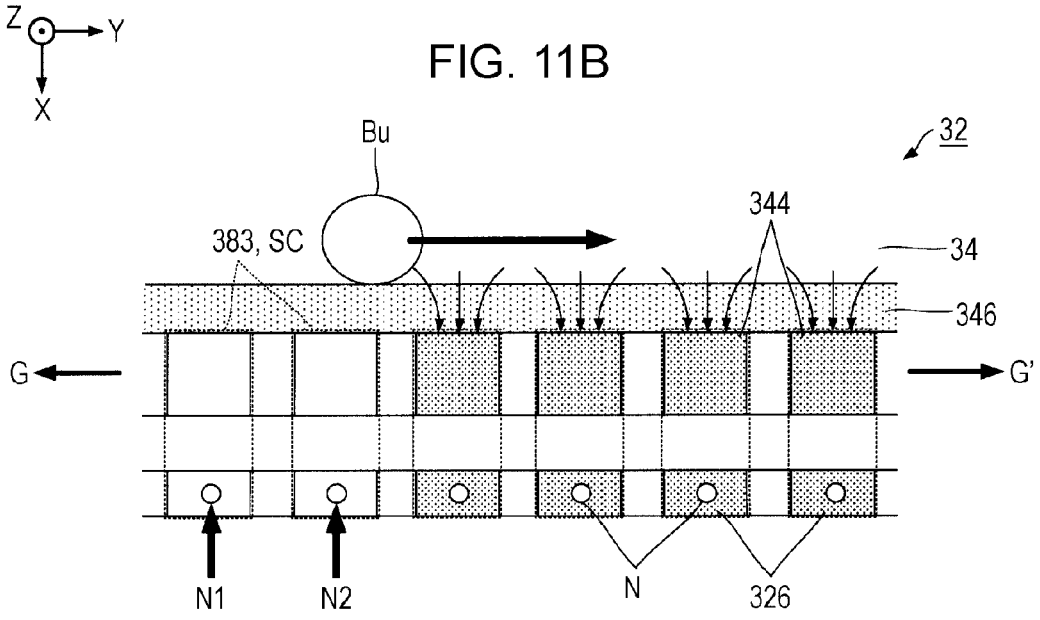
FIG. 11B is an operation-illustrating diagram continuing from FIG. 11A.

FIG. 11A and FIG. 11B are operation-illustrating diagrams regarding a third modification of the maintenance method of the first exemplary embodiment and correspond to FIG. 8A and FIG. 8B. Whereas FIG. 8A and FIG. 8B illustrate an example of the maintenance process in which while a plurality of nozzles N do not expel ink, nozzles N from which ink is expelled are switched sequentially to the end portion G sides, FIG. 11A and FIG. 11B illustrate an example of a maintenance process in which while ink is expelled from a plurality of nozzles N, nozzles N the ink expelling from which is stopped are switched sequentially to the end portion G sides.

During the maintenance process in the third modification illustrated in FIG. 11A and FIG. 11B, the controller 22 expels ink (liquid) from a plurality of nozzles N and stops expelling ink in the order of the first nozzle N1 to the second nozzle N2. FIG. 11A illustrates a state in which while ink is expelled from a plurality of nozzles N, the ink expelling from the first nozzle N1 in the third modification is stopped.

FIG. 11B illustrates a state in which the ink expelling from the second nozzle N2 in the third modification is stopped subsequently to the state illustrated in FIG. 11A. Due to this maintenance process, bubbles Bu in the common liquid chamber 34 are drawn toward where flows are generated. Therefore, the third modification is also able to move bubbles Bu in the common liquid chamber 34 toward the end portions G'.

As for the nozzles from which ink is expelled in the maintenance process of the first exemplary embodiment described above, the nozzles N in the second regions B have a smaller amount of ink expelled than the nozzles N in the first region A. In this exemplary embodiment, the end portion G'-side second regions B in the common liquid chamber 34 have higher flow speeds than the central portion G-side first region A. Therefore, even though the amount of ink expelled from the nozzles N in the second regions B is made smaller than that expelled from the nozzles N in the first region A as described above, bubbles Bu can be sufficiently moved. This achieves an overall reduction of the amount of ink expelled during maintenance.

Furthermore, in the maintenance process of the first exemplary embodiment, the number of nozzles N from which ink is expelled may be less in the second regions B than in the first region A. In this exemplary embodiment, the end portion G'-side second regions B in the common liquid chamber 34 has higher flow speeds than the central portion G-side first region A. Therefore, even though the number of nozzles N from which ink is expelled during the maintenance process is less in the second regions B than in the first region A, bubbles can be sufficiently moved. This also achieves an overall reduction of the amount of ink expelled during maintenance.

Second Exemplary Embodiment

Figure 12:
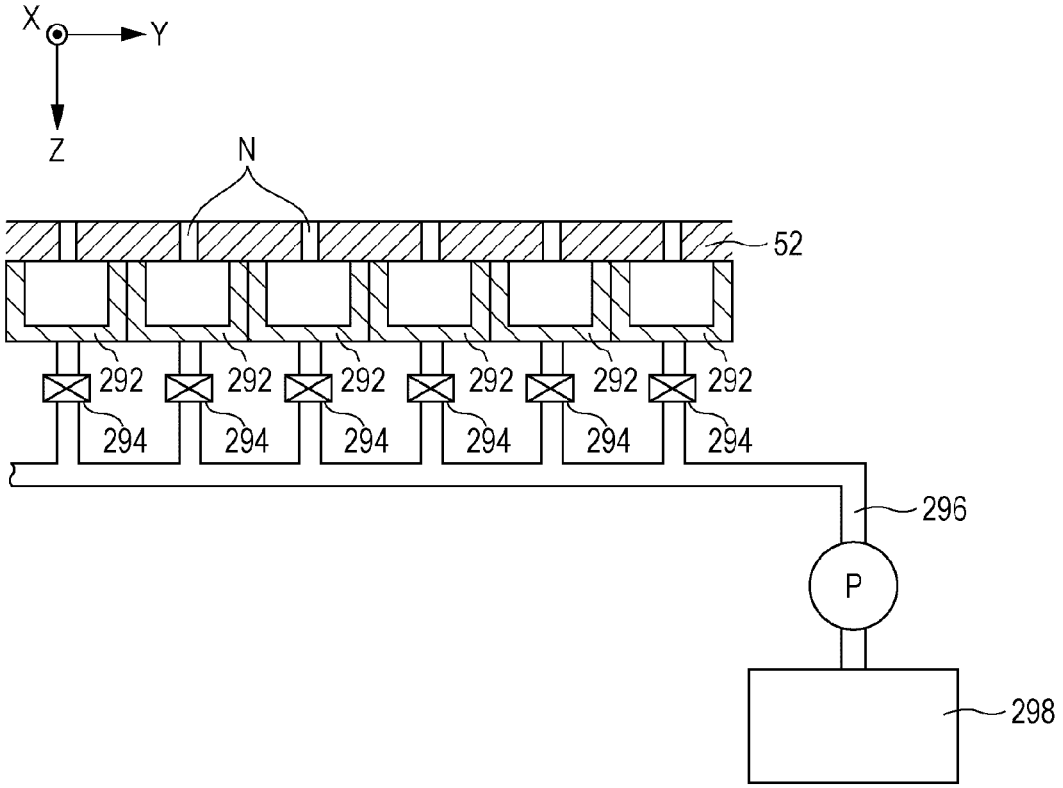
FIG. 12 is a sectional view for describing a construction of a cap of a maintenance mechanism in a second exemplary embodiment.

A second exemplary embodiment of the invention will be described. FIG. 12 is a sectional view illustrating a construction of a cap of a maintenance mechanism in the second exemplary embodiment. Note that components and the like in the second exemplary embodiment which are substantially the same in operation and function as the components and the like in the first exemplary embodiment will be represented by reference characters used for those in the description of the first exemplary embodiment and will be omitted from detailed description below as appropriate. In the second exemplary embodiment, the cap of the maintenance mechanism 29 is divided to caps 292 that separately seal each nozzle N. The caps 292 is connected, via corresponding open/close valves 294, to a suction pipe 296, so that caps 292 from which ink is sucked can be switched. The suction pipe 296 is connected to an ink recovery container 298 via a suction pump P. The recovery container (recovery tank) 298 is a box-shaped container that receive ink expelled into the caps 292.

According to the maintenance mechanism 29 of the second exemplary embodiment described above, ink can be expelled by suction separately for each nozzle N by separately opening and closing each of the open/close valves 294 of the nozzles N. According to this construction, nozzles N from which ink is expelled in the maintenance process can be switched sequentially from the central portion G to the end portion G' sides by separately opening and closing each open/close valve 294. Therefore, similarly to the first exemplary embodiment, local flows that draw bubbles Bu toward supply openings 344 are formed and such local flows are shifted to the end portion G' sides. Hence, the second exemplary embodiment constructed as described above is also capable of moving bubbles Bu to the high-flow speed regions Q of the second regions B in which bubbles Bu are more likely to be expelled, and therefore improves the capability of expelling bubbles Bu that have entered the common liquid chamber 34. Incidentally, in the second exemplary embodiment, the foregoing various modifications of the first exemplary embodiment are also applicable.

Modifications

The exemplary embodiments described above as examples can be modified in various manners. Concrete modifications will be described as examples. Any two or more modifications selected from the following modifications can be appropriately combined unless selected modifications contradict each other.

(1) Although the foregoing exemplary embodiments have been described in conjunction with examples in which the common liquid chamber 34 has such a shape as to continuously expand from the inlet opening 342 side to the supply opening 344 side, the shape of the common liquid chamber 34 is not limited to this shape. For example, the common liquid chamber 34 may expand stepwise (in the manner of stairs). Furthermore, side wall portions of the common liquid chamber 34 that expand from the inlet opening 342 side to the supply opening 344 side do not need to have a planar shape but may have an arcuate shape. It suffices that the common liquid chamber 34 is configured so that, as a result, regions near the end portions G' of the second regions B are regions (high-flow speed regions Q) in which the flow speed is higher than in other regions (e.g., the first region A).

Furthermore, the common liquid chamber 34 does not need to expand from the inlet opening 342 side to the supply opening 344 side. It suffices that the common liquid chamber 34 is configured so that, as a result, regions near the end portions G' of the second regions B are regions (high-flow speed regions Q) in which the flow speed is higher than in other regions (e.g., the first region A). For example, flow path resistance portions (projections, obstacles, etc.) may be provided between the inlet opening 342 and the supply openings 344 in the first region A to intentionally decrease the flow speed in the first region A, so that regions near the end portions G' of the second regions B are regions (high-flow speed regions Q) in which the flow speed is higher than in other regions (e.g., the first region A).

(2) Although the exemplary embodiments have been described in conjunction with the piezoelectric type liquid discharge head 28 in which piezoelectric elements that mechanically vibrate the pressure chambers are employed, it is also possible to adopt a thermal type liquid discharge head that uses heating elements that thermally produce bubbles within the pressure chambers. Furthermore, the configuration of the nozzles N in the liquid discharge head 28 is not limited to what have been described as examples in conjunction with the foregoing exemplary embodiments.

(3) The liquid discharge apparatuses described as examples in conjunction with the foregoing exemplary embodiments can be adopted as appliances dedicated to printing and also as various other appliances such as facsimile apparatuses, copiers, etc. However, uses of the liquid discharge apparatus of the invention are not limited to printing. For example, a liquid discharge apparatus that discharges a solution of a color material can be used as a production apparatus that forms a color filter of a liquid crystal display apparatus. Furthermore, a liquid discharge apparatus that discharges a solution of an electroconductive material can be used as a production apparatus that forms electrodes, wiring, etc., on wiring substrates.

What is claimed is:

1. A liquid discharge apparatus comprising:

a plurality of pressure chambers that generate a pressure for discharging a liquid;

a plurality of nozzles that communicate individually with the pressure chambers arranged in one direction and that discharge the liquid from the pressure chambers;

a common liquid chamber that includes a plurality of supply openings which are arranged along an arrangement of the pressure chambers and through which the liquid is supplied individually to the pressure chambers and that has a first region and a second region, wherein a flow speed of the liquid flowing toward the supply openings is higher in the second region than in the first region as the liquid flows from the first region to the second region; and a controller that controls a maintenance by expelling the liquid from the nozzles, wherein, during the maintenance, the controller controls expelling the liquid from a first nozzle that is located in the first region and a second nozzle that is located in the second region, wherein the maintenance causes the flow of liquid from the first region toward the second region.

2. The liquid discharge apparatus according to claim 1, wherein the plurality of nozzles includes a plurality of the first nozzle adjacent to each other and a plurality of the second nozzle adjacent to each other.

3. The liquid discharge apparatus according to claim 2, wherein of the nozzles from which the liquid is expelled during the maintenance, nozzles in the second region are separated from each other by an interval that is longer than an interval by which nozzles in the first region are separated from each other.

4. The liquid discharge apparatus according to claim 1, wherein of the nozzles from which the liquid is expelled during the maintenance, nozzles in the second region each have a less amount of the liquid expelled than each of nozzles in the first region.

5. The liquid discharge apparatus according to claim 1, wherein the number of nozzles from which the liquid is expelled during the maintenance is less in the second region than in the first region.

6. The liquid discharge apparatus according to claim 1, wherein, during the maintenance, the controller controls a first cleaning in which the liquid is expelled from a plurality of nozzles that include the first nozzle and the second nozzle and then controls a second cleaning in which the liquid is expelled from the plurality of nozzles so that each of the plurality of nozzles has a larger amount of the liquid expelled than each nozzle in the first cleaning.

7. The liquid discharge apparatus according to claim 1, wherein the first region is located at a central part of the common chamber and the second region is located at an end part of the common chamber.

8. The liquid discharge apparatus according to claim 7, wherein the liquid is supplied into the common chamber from the first region.

9. The liquid discharge apparatus according to claim 1, wherein the maintenance is a first maintenance, the first maintenance being followed by a second maintenance, wherein more liquid is discharged during the second maintenance then the first maintenance.

10. The liquid discharge apparatus according to claim 9, wherein the expelling of the liquid during the first maintenance is caused by a driving element that individually generates a pressure in the pressure chamber and the expelling of the liquid during the second maintenance is caused by a maintenance mechanism that sucks the liquid from the nozzles.

11. A liquid discharge apparatus comprising:

a plurality of pressure chambers that generate a pressure for discharging a liquid;

a plurality of nozzles that communicate individually with the pressure chambers arranged in one direction and that discharge the liquid from the pressure chambers;

a common liquid chamber that has an inlet opening through which the liquid flows into the common liquid chamber and a plurality of supply openings which are arranged along an arrangement of the pressure chambers and through which the liquid is supplied individually to the pressure chambers and that has a first region and a second region, wherein a width of the first region is greater than the width of the second region; and a controller that controls a maintenance by expelling the liquid from the nozzles, wherein the common liquid chamber has a first width in the one direction on which the inlet opening is located and a second width in the one direction on which the supply openings are located and the second width is greater than the first width, and wherein, during the maintenance, the controller controls expelling the liquid from a first nozzle that is located in the first region and a second nozzle that is located in the second region, wherein the maintenance causes the flow of liquid from the first region toward the second region, wherein of the nozzles from which the liquid is expelled during the maintenance, nozzles in the second region each have a less amount of the liquid expelled than each of nozzles in the first region.

12. The liquid discharge apparatus according to claim 11, wherein the plurality of nozzles includes a plurality of the first nozzle adjacent to each other and a plurality of the second nozzle adjacent to each other.

13. The liquid discharge apparatus according to claim 12, wherein of the nozzles from which the liquid is expelled during the maintenance, nozzles in the second region are separated from each other by an interval that is longer than an interval by which nozzles in the first region are separated from each other.

14. The liquid discharge apparatus according to claim 11, wherein the first region is located at a central part of the common chamber and the second region is located at an end part of the common chamber.

15. The liquid discharge apparatus according to claim 14, wherein the liquid is supplied into the common chamber from the first region.

16. The liquid discharge apparatus according to claim 11, wherein the maintenance is a first maintenance, the first maintenance being followed by a second maintenance, wherein more liquid is discharged during the second maintenance then the first maintenance.

17. The liquid discharge apparatus according to claim 16, wherein the expelling of the liquid during the first maintenance is caused by a driving element that individually generates a pressure in the pressure chamber and the expelling of the liquid during the second maintenance is caused by a maintenance mechanism that sucks the liquid from the nozzles.

18. A maintenance method for a liquid discharge apparatus which performs a maintenance by expelling a liquid from a plurality of nozzles, the liquid discharge apparatus including a plurality of pressure chambers that generate a pressure for discharging a liquid, a plurality of nozzles that communicate individually with the pressure chambers arranged in one direction and that discharge the liquid from the pressure chambers, a common liquid chamber that includes a plurality of supply openings which are arranged along an arrangement of the pressure chambers and through which the liquid is supplied individually to the pressure chambers and that has a first region where the liquid is supplied to the common liquid chamber and a second region, wherein a flow speed of the liquid flowing toward the supply openings is higher in the second region than in the first region as the liquid flows from the first region to the second region; and a controller that controls the maintenance by expelling the liquid from the nozzles, the maintenance method comprising expelling the liquid from a first nozzle that is located in the first region and a second nozzle that is located in the second region, wherein the maintenance causes the flow of liquid from the first region toward the second region.

* * * * *